US006289183B1

(12) United States Patent
Miyake

(10) Patent No.: US 6,289,183 B1
(45) Date of Patent: Sep. 11, 2001

(54) SHEET CONVEYING APPARATUS AND IMAGE FORMING APPARATUS HAVING THE SAME

(75) Inventor: Hiroaki Miyake, Moriya-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/467,177

(22) Filed: Dec. 20, 1999

(30) Foreign Application Priority Data

Dec. 21, 1998 (JP) ..... 10-363535

(51) Int. Cl.[7] ..... G03G 15/00
(52) U.S. Cl. ..... 399/16; 399/21; 399/381
(58) Field of Search ..... 399/16, 18, 21, 399/381, 396; 271/264, 266, 270, 314

(56) References Cited

U.S. PATENT DOCUMENTS 4,234,305 11/1980 Miyake et al. ..... 432/59
4,548,394 * 10/1985 Koyama et al. ..... 271/266 X
4,954,848 * 9/1990 Arima ..... 399/21 X
5,010,363 * 4/1991 Higashio et al. ..... 399/21 X
5,136,342 * 8/1992 Ida et al. ..... 399/396
5,415,387 * 5/1995 Suzuki ..... 271/270 X
5,775,686 7/1998 Miyake ..... 271/127

FOREIGN PATENT DOCUMENTS 0 768 186 4/1997 (EP) .
10-333379 12/1998 (JP) .

* cited by examiner

*Primary Examiner*—Sandra Brase
(74) *Attorney, Agent, or Firm*—Fitzpatrick, Cella, Harper & Scinto

(57) ABSTRACT

In a sheet conveying apparatus, starting sound is reduced and downsizing is contrived without causing any increase in cost. The sheet conveying apparatus is provided with a plurality of pairs of rotary members disposed along a sheet conveying path for guiding a sheet, and conveying the sheet, a plurality of rotary driving devices for rotating the pairs of rotary members, and a control device for staggering the starting time of each rotary driving device and starting the rotary driving devices.

15 Claims, 8 Drawing Sheets

SHEET CONVEYING APPARATUS AND IMAGE FORMING APPARATUS HAVING THE SAME

BACKGROUND OF THE INVENTION

1. Field of the Invention

This invention relates to a sheet conveying apparatus for conveying sheets, and an image forming apparatus such as a copier, a facsimile apparatus, a laser printer or a compound apparatus of these having the sheet conveying apparatus.

2. Related Background Art

A sheet conveying apparatus for conveying sheets has heretofore been provided, for example, in an image forming apparatus.

This sheet conveying apparatus is provided with a plurality of pairs of rollers, disposed along a sheet conveying path for guiding sheets, for conveying the sheets, and a plurality of drive motors for rotating the pairs of rollers and other rotary members, and is adapted to convey a sheet fed from a sheet cassette to image forming means for forming an image on one surface of the sheet, and thereafter discharge the sheet out of the main body of an image forming apparatus, or convey the sheet having an image formed on one surface thereof again to the image forming means to thereby form an image also on the other surface of the sheet, and thereafter discharge the sheet out of the main body of the image forming apparatus.

Now, the sheet conveying apparatus makes initial multiple rotations during the opening and closing of the front face opening and closing cover of the main body of the image forming apparatus. These multiple rotations are effected, supposing that after the clearance of jam, there is a sheet left in the image forming apparatus, to drive each pair of rollers for a predetermined time to thereby convey the sheet from a position at which it has not been detected by a sheet detecting sensor disposed in a sheet conveying path to an area in which the sheet detecting sensor can detect the sheet, and operate the sheet detecting sensor to inform a user.

These initial multiple rotations are generally effected to confirm the absence of remaining sheets in the image forming apparatus also when the power source switch of the image forming apparatus in its normal state is closed.

In the sheet conveying apparatus according to the conventional art, however, the conveying rollers have been started at a time during the initial multiple rotations and therefore, shock sounds and starting sounds during the meshing engagement between gears have been created at a time, and the starting sounds have become great and have given unpleasant feeling to the user. So, a countermeasure for the sounds has been taken by reinforcing the mounting portions for the drive motors or using a damping material and a soundproof material for each part of the image forming apparatus or the main body of the image forming apparatus and therefore, the size of the main body of the image forming apparatus has sometimes become large.

SUMMARY OF THE INVENTION

It is an object of the present invention to provide a sheet conveying apparatus in which a starting sound is reduced without causing a great increase in cost, and an image forming apparatus which is provided with this sheet conveying apparatus and is made compact.

The sheet conveying apparatus of the present invention is provided with a plurality of pairs of rotary members, disposed along a sheet conveying path for guiding a sheet, for conveying the sheet, a plurality of rotary driving means for rotating the pairs of rotary members, and control means for staggering the starting time of each of the rotary driving means and starting the rotary driving means.

The sheet conveying apparatus conveys the sheet along the sheet conveying path by the rotation of the pairs of rotary members. The pairs of rotary members are rotated by the rotary driving means. Each of the rotary driving means is started by the control means with the starting time thereof staggered.

Accordingly, in the sheet conveying apparatus of the present invention, the starting noise by the rotary driving means is low during the starting thereof.

In the sheet conveying apparatus of the present invention, the control means may start in the order from the rotary driving means corresponding to the pair of rotary members on the upstream side in the sheet conveying direction.

The sheet conveying apparatus is designed such that in the normal state thereof or after the clearance of sheet jam, the rotary driving means are started in the order from the upstream side in the sheet conveying direction and therefore, even if it happens that the upstream end and downstream end of a sheet are interposed between the pair of rotary members on the upstream side and the pair of rotary members on the downstream side, it will never happen that the pair of rotary members on the downstream side pulls and tears the sheet. Also, it will never happen that the rotary driving means on the upstream side is pulled by the rotary driving means on the downstream side through the sheet and steps out.

In the sheet conveying apparatus of the present invention, from the rotary driving means corresponding to the pair of rotary member on the upstream side, the rotary driving means may be divided into a plurality of groups, and the control means may start in the order from the group on the upstream side.

In the sheet conveying apparatus of the present invention, the control means may accelerate and rotate the pairs of rotary members to such a degree as not to impart damage to the sheet, during the time after the start of the conveyance of the sheet and until the sheet assumes a predetermined conveyance speed.

The sheet conveying apparatus starts the conveyance of the sheets without imparting damage to the sheets.

In the sheet conveying apparatus of the present invention, a plurality of sheet detecting means for detecting the sheet may be disposed along the sheet conveying path, and the control means may stop the rotary driving means when a jammed sheet is detected by the sheet detecting means.

In the sheet conveying apparatus, when sheet jam occurs, the jammed sheet may be detected by the sheet detecting means and the control means may stop the rotary driving means.

In the sheet conveying apparatus of the present invention, the pairs of rotary members may be pairs of rollers, and the rotary driving means may be motors.

The rotary driving means may be clutches for transmitting the rotational forces of motors to said pairs of rotary members.

The image forming apparatus of the present invention is provided with any one of the aforementioned sheet conveying apparatuses, and image forming means disposed in the course of the sheet conveying path of the sheet conveying apparatus for forming images on sheets conveyed along the sheet conveying path.

DESCRIPTION OF THE PREFERRED EMBODIMENT

Figure 1:
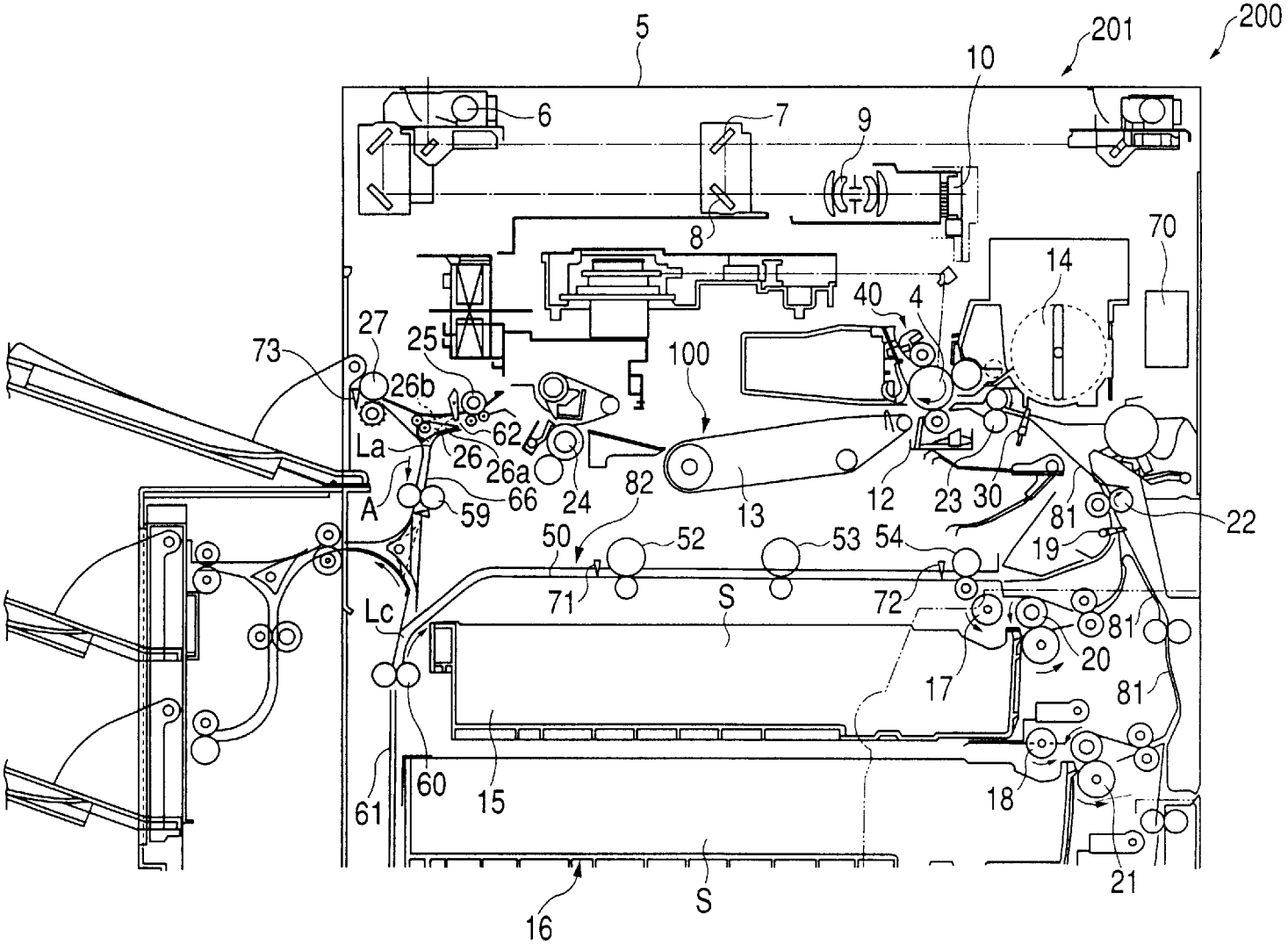
FIG. 1 is a schematic front cross-sectional view of a copier which is an image forming apparatus provided with a sheet conveying apparatus according to an embodiment of the present invention.

A sheet conveying apparatus 100 according to an embodiment of the present invention and a copier 200 which is an image forming apparatus provided with the sheet conveying apparatus 100 in the main body 201 of the copier 200 will hereinafter be described with reference to the drawings.

The sheet conveying apparatus according to the embodiment of the present invention can be provided not only in a copier, but also in the main body of a facsimile apparatus or a printer or a compound apparatus of these, and is not restricted to being provided in the main body 201 of the copier 200.

Also, sheets include plain paper, thin sheets of resin which are substitutes for the plain paper, postcards, paper boards, envelopes, thin sheets made of plastics, etc.

The copier 200 is adapted to be capable of copying images on both of the front and back surfaces of a sheet.

This image forming apparatus is provided with a plurality of sheet supply cassettes 15 and 16. Sheets S of different sizes contained in these sheet supply cassettes 15 and 16 are adapted to be selectively fed to image forming means 40.

The sheets S contained in the sheet supply the uppermost sheet onto a sheet feeding path 81 by sheet pickup rollers 17 and 18 rotated in the directions indicated by the arrows. The sheet feeding path 81 is adapted to guide the sheets from the sheet supply cassettes 15 and 16 to the image forming means 40 which will be described later.

The sheets S picked up by the sheet pickup rollers 17 and 18 are separated one by one by pairs of separation rollers 20 and 21 rotated in the directions indicated by the arrows and are fed to a pair of second registration rollers 22 and a pair of registration rollers 23 which are being stopped from rotation.

The sheet S fed by the pairs of separation rollers 20 and 21 forms a predetermined loop and corrects its skew feed when its leading end strikes against the nip between the pair of registration rollers 22.

The sheet S having had its skew feed corrected is sent to between the photosensitive drum 4 of the image forming means 40 and a transfer charger 12 by the pair of registration rollers 22 starting to rotate in the direction indicated by the arrow in exact timing with the position of a toner image on the photosensitive drum 4 rotated in the direction indicated by the arrow, and there the toner image on the photosensitive drum 4 is transferred to the sheet by the transfer charger 12.

In the present copier 200, the image of an original set on platen glass 5 is read onto a CCD 10 by an optical system comprising an illuminating lamp 6, reflecting mirrors 7, 8, a zoom lens 9, etc., and is applied as a laser beam onto the photosensitive drum 4 rotated in the direction indicated by the arrow by a laser scanner via desired image processing. Thereby an electrostatic latent image is formed on the photosensitive drum 4, and this electrostatic latent image is visualized by a black toner supplied from a developing device 14 and becomes a toner image.

The sheet S to which the toner image has been transferred in the image forming means 40 is sent to a fixing roller 24 by a conveying belt 13, and the toner image is fixed on the sheet by the fixing roller 24.

In the case of the one side copy and face-up sheet discharging mode, the sheet S on which the toner image has been fixed is sent to a pair of outer sheet discharge rollers 27 by an inner sheet discharge roller 25, and is discharged onto a sheet discharge tray outside the main body of the image forming apparatus by the pair of outer sheet discharge rollers 27 with its image bearing surface facing upward. At this time, a flapper 26 installed in a branch-off portion is changed over to a position indicated by the reference character 26*a*.

In the case of the face-down sheet discharging mode, the sheet sent from the inner sheet discharge roller 25 is conveyed to a conveying path 66 side by the flapper 26 being changed over to a position indicated by the reference character 26*b*, and is sent in the direction indicated by the arrow A by a sheet discharge surface reverse roller 59, and at a point of time whereat the trailing end of the sheet has substantially arrived at a position La, the sheet discharge surface reverse roller 59 is reversed in rotation whereby the sheet is sent to the pair of outer sheet discharge rollers 27, by which the sheet is discharged onto the sheet discharge tray with its image bearing surface facing downward.

In the case of the both-side copy mode, as in the face-down sheet discharging mode, the sheet sent from the inner sheet discharge roller 25 is conveyed to the conveying path 66 side by the flapper 26 being changed over to the side indicated by the reference character 26*b*, and is sent in the direction indicated by the arrow A by the sheet discharge surface reverse roller 59 and a both-face surface reverse roller 60, and at a point of time whereat the trailing end of the sheet having come into a sheet surface reverse path 61 has substantially arrived at a position Lc, the both-face surface reverse roller 60 is reversed in rotation, and the sheet is sent to a sheet re-feeding path 50 with its image bearing surface inside.

Among the above-described constituents, the sheet feeding path 81, the conveying belt 13, the conveying path 66, the sheet surface reverse path 61 and the sheet re-feeding path 50 together form a sheet conveying path 82.

Figure 2:
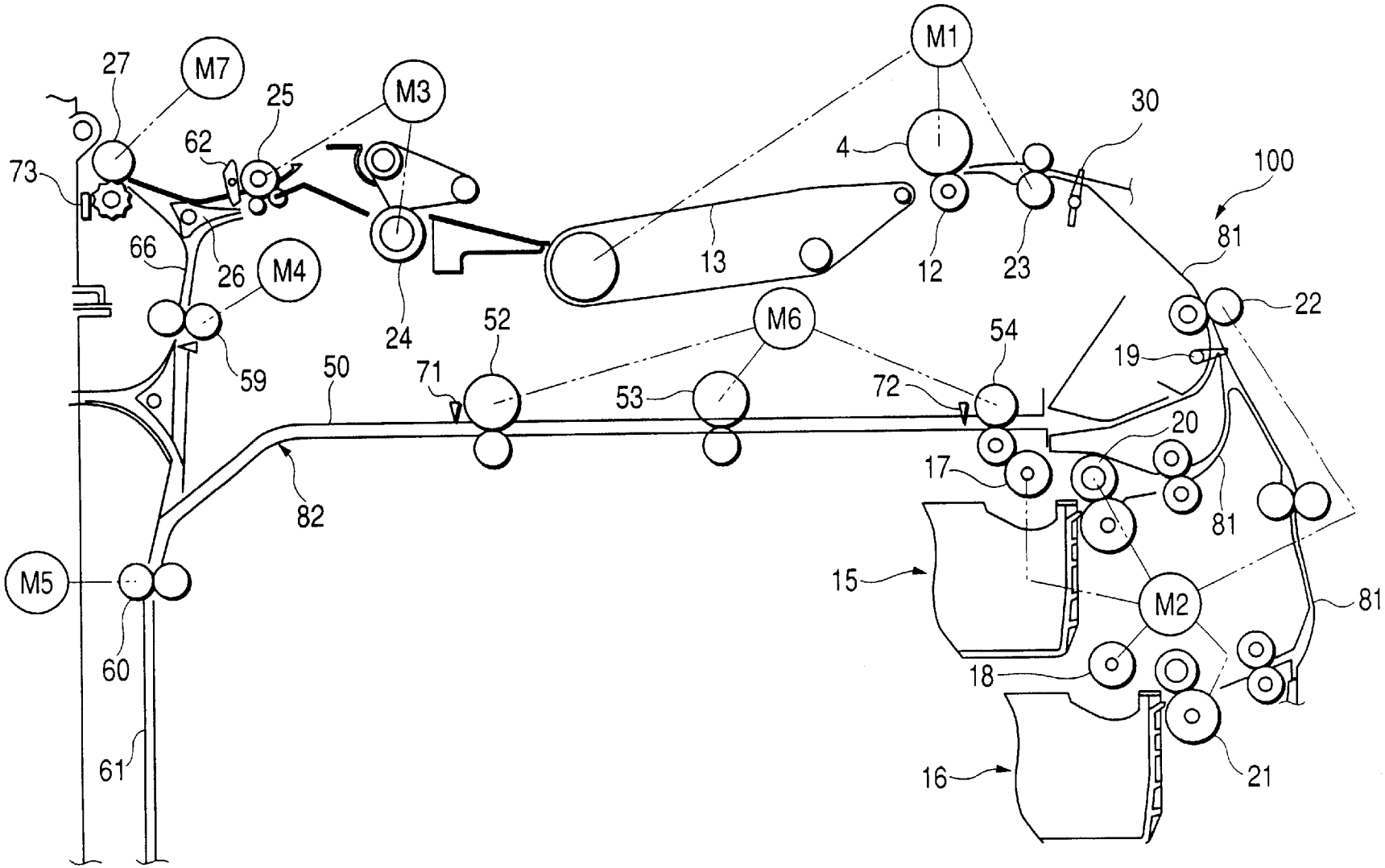
FIG. 2 is a schematic front view of the sheet conveying apparatus in FIG. 1.

Among the above-described constituents, the rotary parts (the pairs of rotary members) are adapted to be rotated by motors (rotary driving means) M1, M2, M3, M4, M5, M6 and M7, as shown in FIG. 2.

That is, the photosensitive drum 4, and the registration rollers 23 and the conveying belt 13 constituting first conveying means are rotated by the main motor M1, the sheet pickup rollers 17, 18, the pairs of sheet separation rollers 20, 21 and the registration roller 22 constituting second conveying means are rotated by the sheet feed motor M2 using a stepping motor, the fixing roller 24 and the inner sheet discharge roller 25 constituting third conveying means are rotated by the fixing motor M3 using a DC motor, the sheet discharge surface reverse roller 59 constituting fourth conveying means is rotated by the discharge sheet surface reverse motor M4 using a stepping motor, the both-face surface reverse roller 60 constituting fifth conveying means is rotated by the both-face surface reverse motor M5 using a stepping motor, the three pairs of both-face rollers 52, 53 and 54 arranged in the sheet re-feeding path 50 constituting sixth conveying means are rotated by the both-face motor M6 using a stepping motor, and the outer sheet discharge roller 27 constituting seventh conveying means is rotated by the outer sheet discharge motor M7 using a stepping motor.

Figure 4:
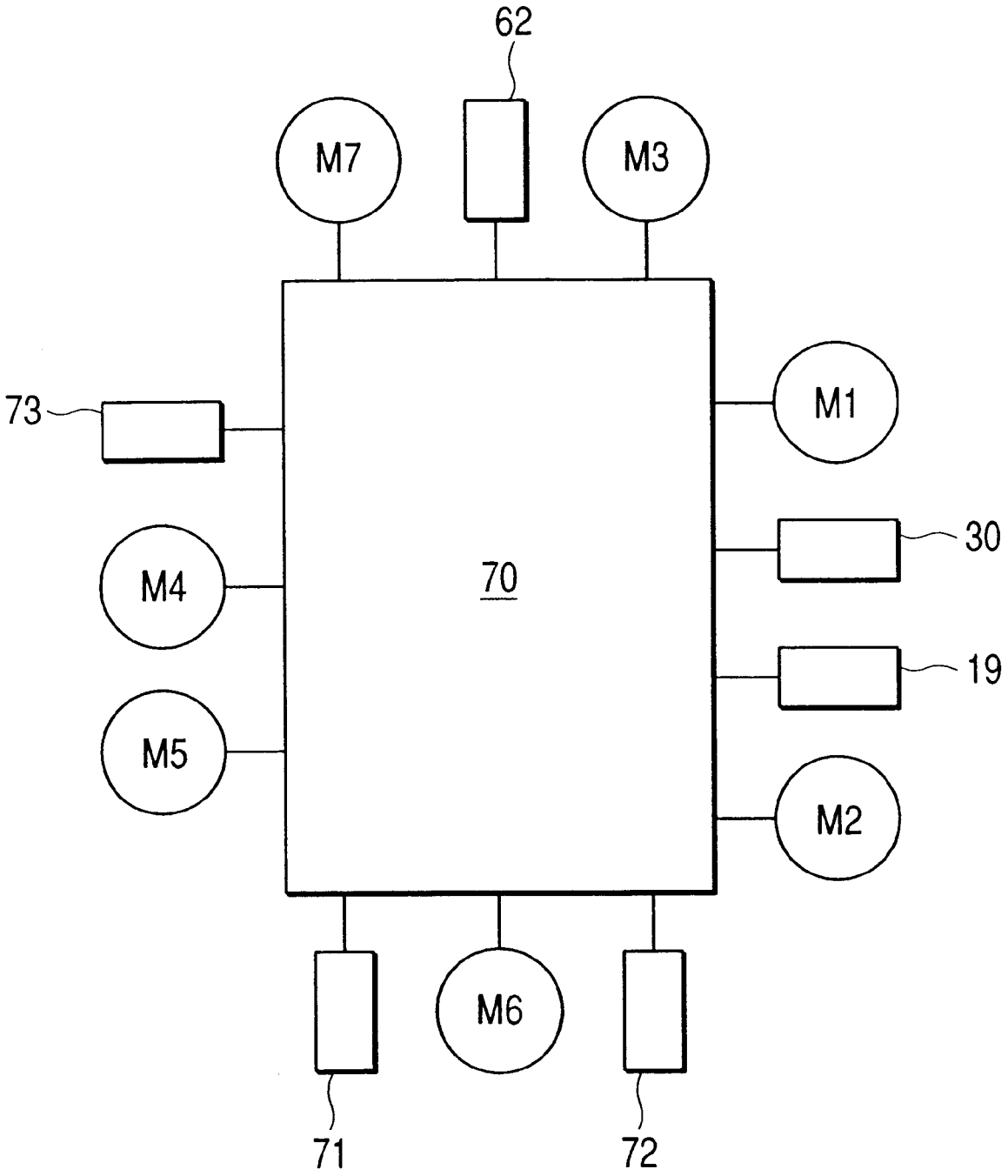
FIG. 4 is a block diagram of the control relation of the sheet conveying apparatus of FIG. 2.
Figure 5:
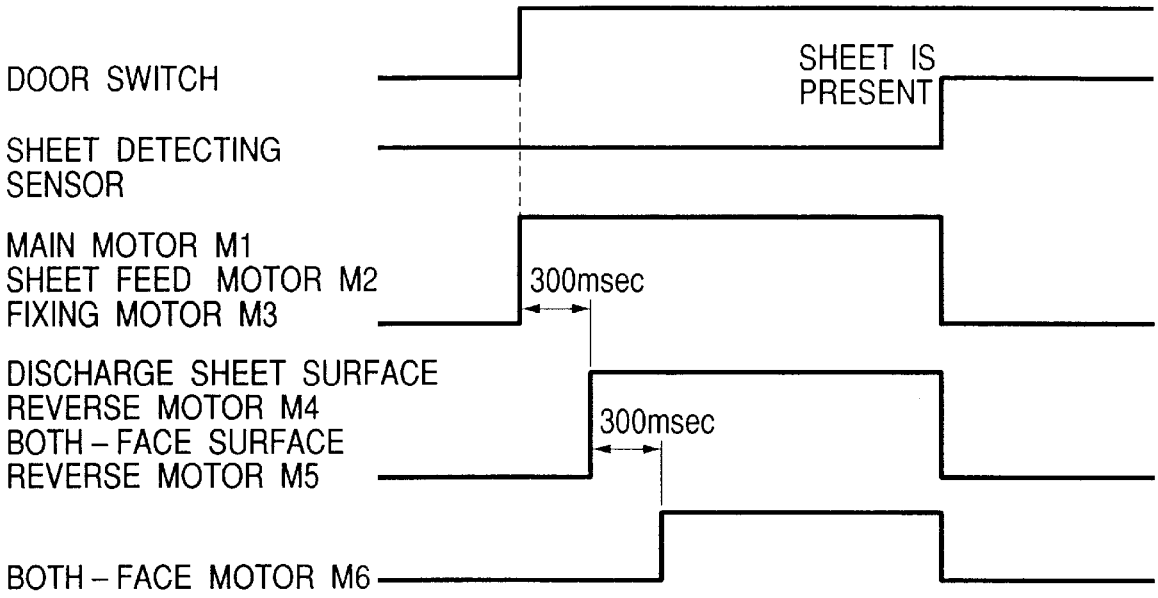
FIG. 5 is a time chart showing the started state of each motor.

As sheet detecting sensors (sheet detecting means), as shown in FIGS. 1, 2 and 4, provision is made of an ante-registration sensor 30, a second registration sensor 19, an inner sheet discharge sensor 62, a both-face entrance sensor 71, a both-face sheet re-feed sensor 72, and an outer sheet discharge sensor 73. The processing control during sheet jam (occurrence of jam) and the initial multiple rotation control after sheet jam clearance (jam clearance) are all designed to be effected by a CPU (control means) 70.

The CPU 70 is adapted to indicate sheet jam on the operating portion of the copier as sheet jam having occurred as will be described later when the time after each sensor has detected the leading end of the sheet and until each sensor detects the trailing end of the sheet is longer than a predetermined time.

Figure 3:
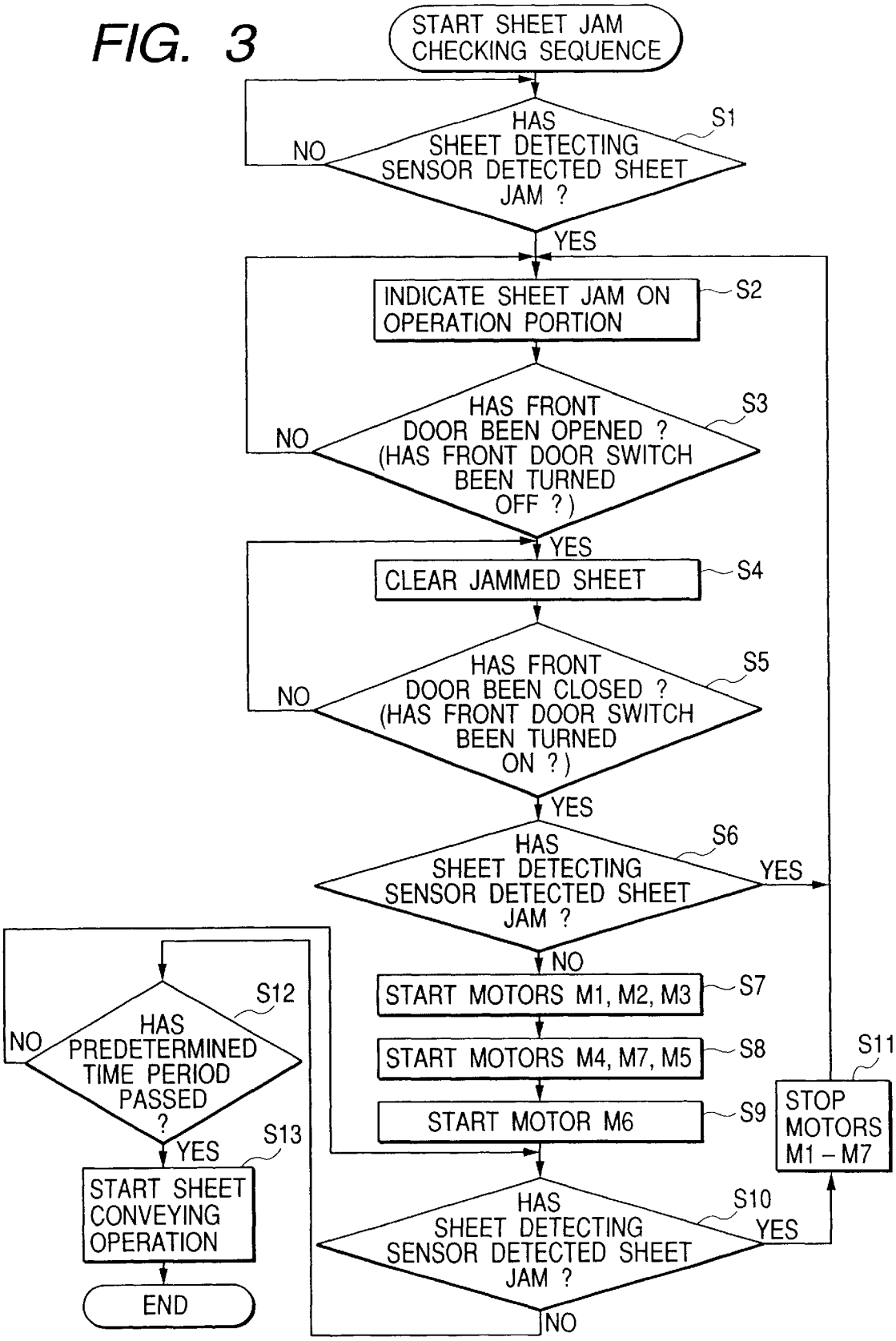
FIG. 3 is a flowchart of the sheet jam clearance in the copier of FIG. 1.

The sheet jam clearance when sheet jam has occurred will now be described with reference to the flowchart of FIG. 3 and the block diagram of FIG. 4.

Each sheet detecting sensor checks up sheet jam (step (hereinafter abbreviated as "S") 1). When sheet jam has occurred during printing, these sheet detecting sensors detect the presence of a jammed sheet and inform the user of it. In the case of a copier, the sheet jam location is indicated clearly and the sheet jammed state (jammed state) is indicated on the screen of an operation portion (S2).

When as the sheet jam clearance sequence, a front door, not shown, is opened by the user, a front door switch as detecting means is turned off (S3). When the user does not open the front door, the sheet jam location remains indicated clearly on the screen of the operation portion (S2).

The user opens the front door and confirms the presence or absence of a sheet in the apparatus, and clears a jammed sheet (S4), and closes the front door (S5). The front door switch is turned on.

When at this time, there are a plurality of sheets in the apparatus, the user may forget to take them away and leave the sheets in the apparatus. Therefore, after the front door has been closed, sheet jam is again detected by each sheet detecting sensor (S6), and if a jammed sheet is left, return is made to S2.

Also, at S6, a jammed sheet remaining in the apparatus may sometimes be outside the detection range of the sheet detecting sensor. Therefore, to perform the initial multiple rotation operation before the copier is started on a full scale, the sheet feed motor M2, the main motor M1 and the fixing motor M3 are first started (S7). About 300 msec. after, the discharge sheet surface reverse motor M4, the outer sheet discharge motor M7 and the both-face surface reverse motor M5 on the downstream side are started. About further 300 msec. after, the both-face motor M6 is started.

As described above, the motors are started in the order from the upstream side in the sheet conveying direction. If at this time, the motors are started in the order from the downstream side, there occurs a case where the sheet is pulled out from the pair of rollers depending on the manner in which the sheet remains. If in such a case, there is no surplus in the torque of the motors, the motors may step out and also, the sheet may be torn and it may become difficult for the jammed sheet to be cleared. Thus, in order to prevent the step-out of the motors and the tear or the like of the sheet, the motors are started in the order from the upstream side. Also, at this time, the starting interval of about 300 msec. may have a degree of freedom. That is, since the motors are started in the order from the upstream side, there is the possibility that a sheet strikes against the rollers on the downstream side and a loop is formed in the sheet, but supposing that a sheet remains immediately before the sheet detecting sensor, with the distance between the sheet detecting sensor and the nip between the pair of rollers and the gap or the like between the sheet guides taken into account, the starting intervals among the motors can be set to such a degree that the sheet does not buckle.

The discharge sheet surface reverse motor M4 and the both-face surface reverse motor M5 are rotatable in forward and reverse directions for the rollers 59 and 60 to feed sheets in forward and revere directions, and it is to be understood that they are rotated in a direction to output the sheets out of the apparatus (the reverse direction) to increase the visibility of jammed sheets.

After the above-described initial multiple rotation operation, the operation of detecting the presence or absence of a jammed sheet (S10) is again performed for a predetermined time period by the sheet detecting sensor (S12). If during this time, a jammed sheet is detected, the rotation of the motors M1 to M7 is stopped at that point of time (S11), and the sheet jam clearance operation is repeated. If no jammed sheet is detected by the sheet detecting sensor after the predetermined time period has passed in the initial multiple rotations (S12), the rotation of the motors Ml to M7 is continued and shift is made to a state in which the sheet is conveyed (S13).

The initial multiple rotation operation has been described above in connection with the sheet jam clearance and the initial multiple rotation operation is also performed when the copier is started. Accordingly, in the present sheet conveying apparatus, by the motors being started in the order from the upstream side, it becomes possible to reduce the stepout and noise of the motors after the sheet jam clearance, or reduce the noise during the starting of the copier in its normal state, and the unpleasant feeling given to the user can be eliminated.

While in the foregoing description, the motors are divided into groups at S7, S8 and S9 and the motors are started in the order from the upstream group and the motors in the respective groups are started at a time, the motors may be started in the order from the motor corresponding to the upstream roller.

Figure 6:
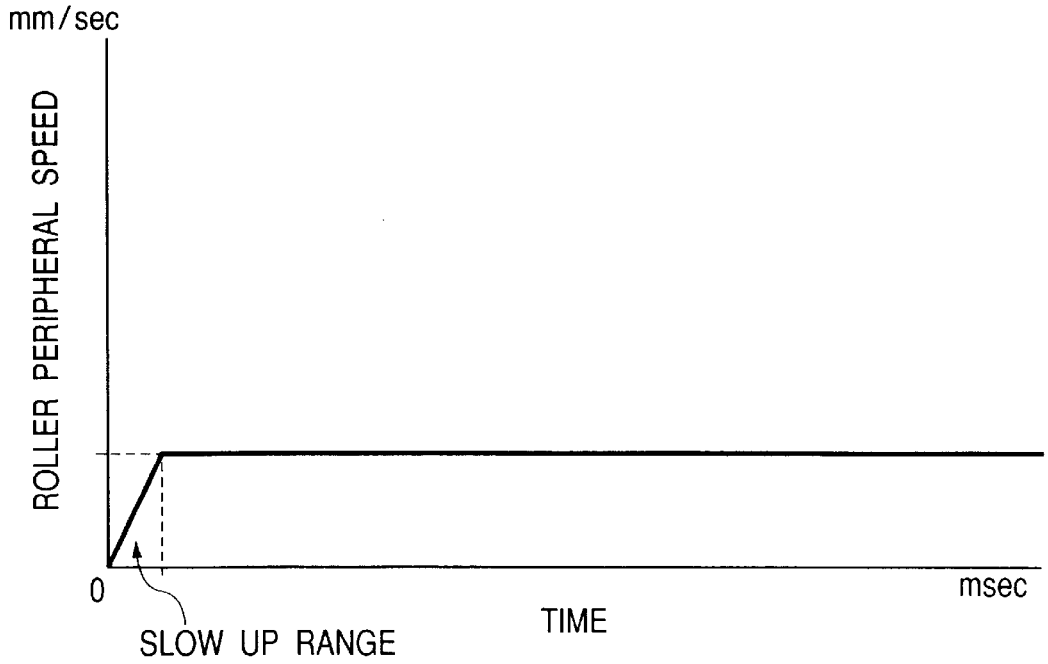
FIG. 6 is a time chart showing a peripheral speed of a roller during slow up control.

As another embodiment of the sheet conveying apparatus, there is a sheet conveying apparatus in which the starting during the rising of the sheet feed motor M2, the discharge sheet surface reverse motor M4, the both-face surface reverse motor M5, the both-face motor M6 and the outer sheet discharge motor M7 using stepping motors is under slow up control (see FIG. 6). Thereby, it becomes possible to gradually accelerate the rotation during the rising of the motors and the pairs of rollers and therefore, the noise during the starting of the motors is further reduced and the tear of the sheets can be prevented.

While in the foregoing description, the rollers 17, 18, 20, 21, 22, 23, 24, 25, 59, 60, 52, 53, 54, the photosensitive drum 4 and the conveying belt 13 are adapted to be rotated by the motors M1 to M7, the number of the motors may be made smaller (one at a minimum), and the rollers, the photosensitive drum and the conveying belt may be connected to the motors reduced in number through a clutch, and the clutch may be operatively controlled by a control circuit to thereby perform the above-described initial multiple rotation operation. Accordingly, it is to be understood that the rotary driving means in the present invention may include a clutch besides the motors.

Figure 7:
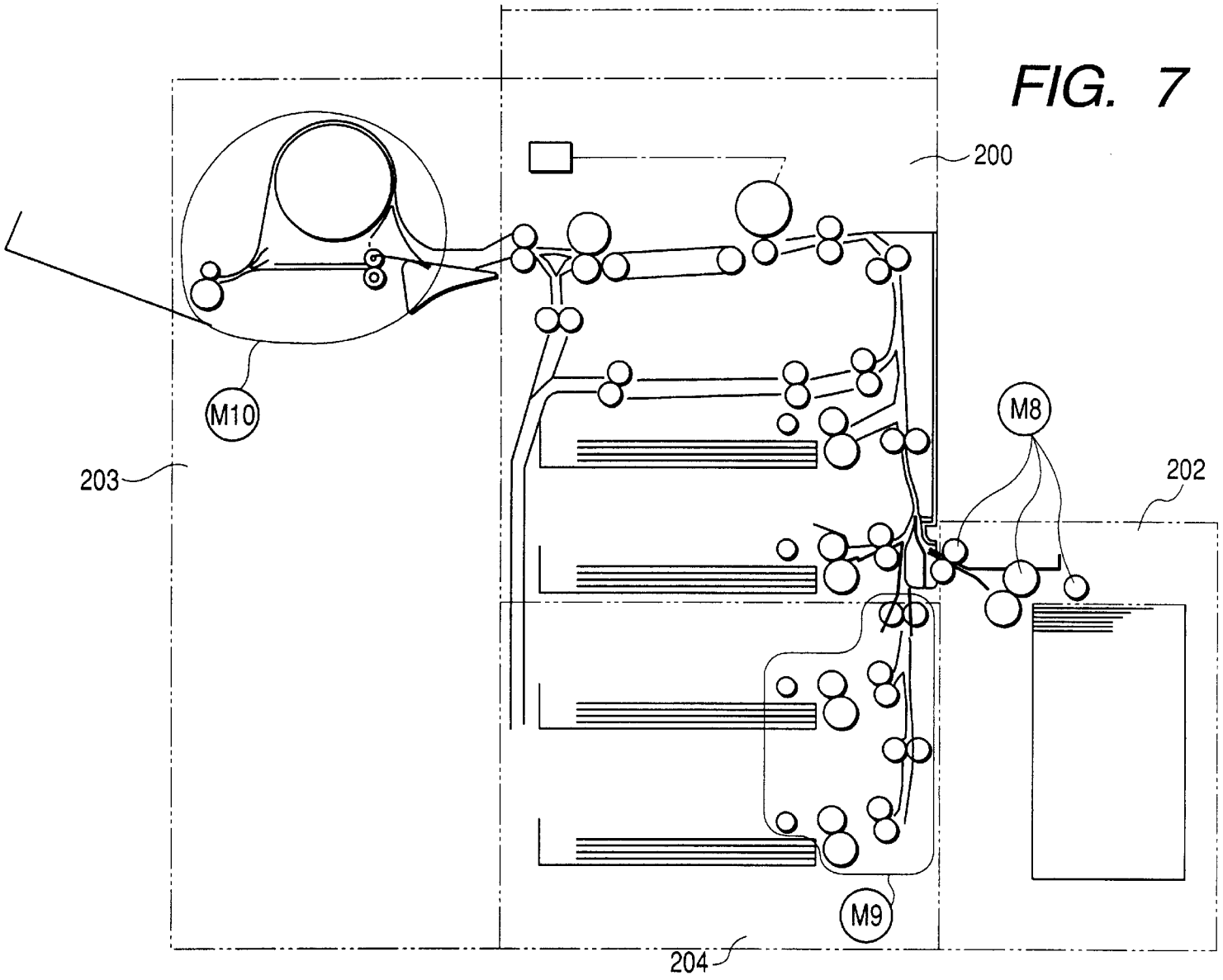
FIG. 7 is a schematic front view of the sheet conveying apparatus including accessories.

While the above embodiment has been described with respect only to the main body of the image forming apparatus, a similar way of thinking is also possible with regard to the entire apparatus including sheet feed accessories 202, 204 and a sheet discharge accessory 203 as shown in FIG. 7.

Figure 8:
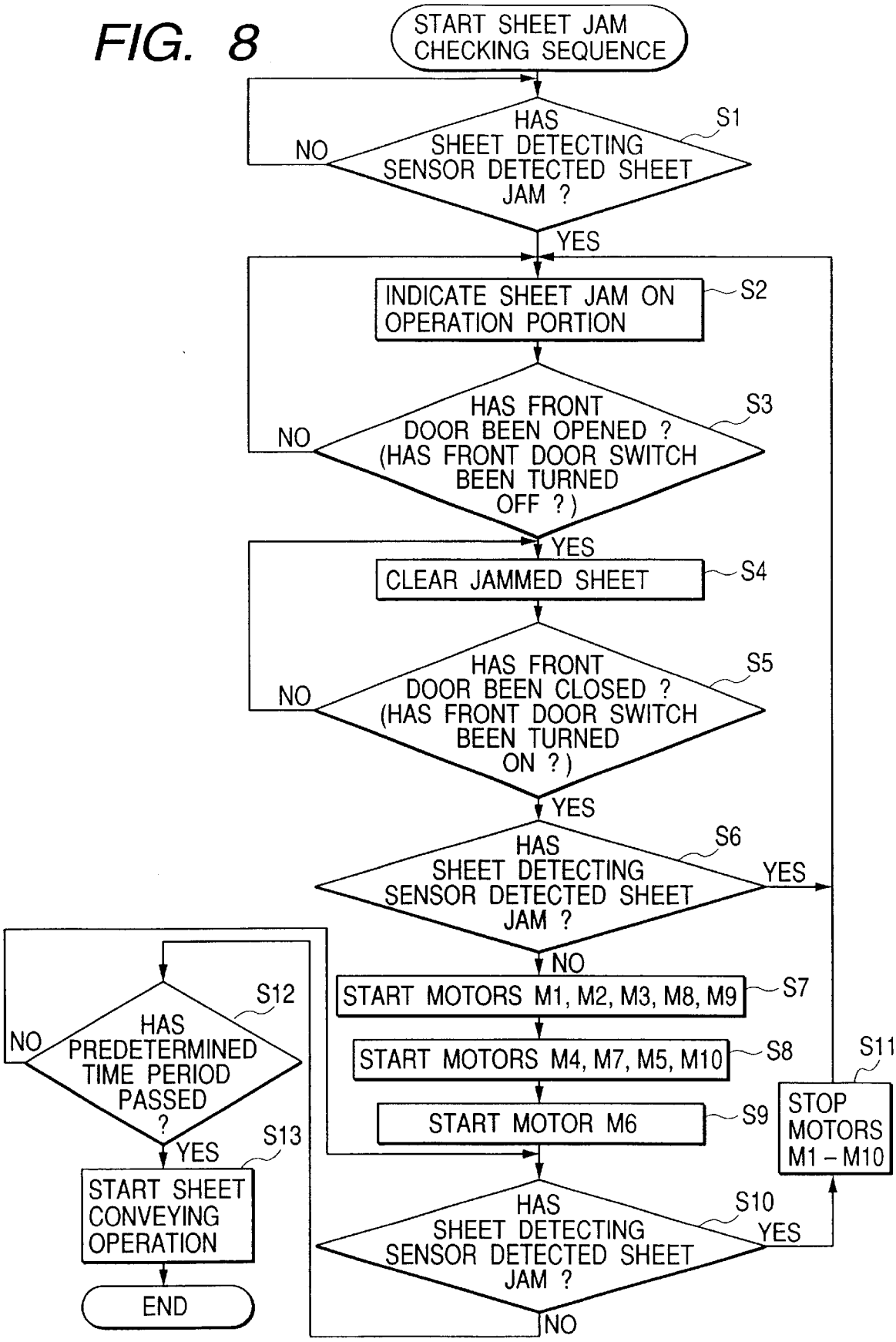
FIG. 8 is a flowchart of the sheet jam clearance in FIG. 7.

As regards the drive motors in this case, the sheet feed deck 202 is driven by a motor M8, the sheet feed pedestal 204 is driven by a motor M9, and the finisher 203 is driven by a motor M10. The procedure of initial multiple rotations is such that the motors are driven in the order from the upstream side even if these accessories are mounted. As shown in the flowchart of FIG. 8, the motors M8 and M9 are started simultaneously with the motors M1, M2 and M3 (S7), and the motor M10 is started simultaneously with the motors M4, M5 and M7 (S8). The sheet feed deck 202 and the sheet feed pedestal 204 are not moved at a time so that sheets may not overlap each other and therefore, one of them is controlled. Also, when it is apparent that sheet jam has occurred only in the accessory portion and no sheet remains in the main body 200 of the image forming apparatus, the motors M1 to M7 need not be rotated.

Figure 9:
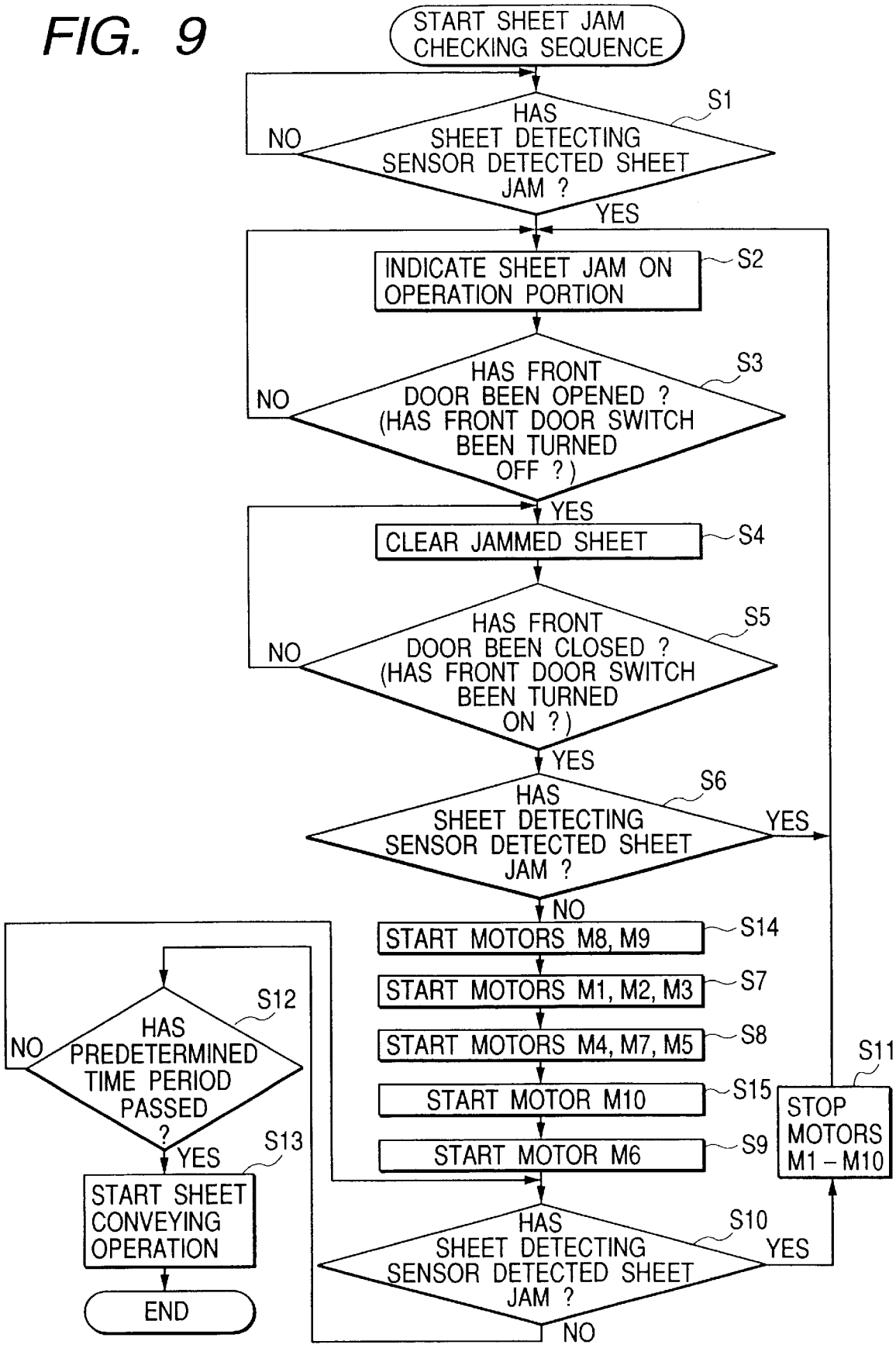
FIG. 9 is another flowchart of the sheet jam clearance.

When as in the present embodiment, the drive sources of the accessories are discrete, the control as described above may not be effected, but the starting may be staggered as shown in FIG. 9. That is, the step S14 of starting the motors M8 and M9 may be provided between S6 and S7. The step S15 of starting the motor M10 may be provided between S8 and S9.

In the sheet conveying apparatus of the present invention, the time for starting the plurality of rotary driving means for rotating the pairs of rotary members is staggered and therefore, the starting sound of the rotary driving means becomes small and the unpleasant feeling given to the user can be eliminated. Also, it becomes unnecessary to increase the strength of the mounting portion for the rotary driving means or use a damping material and a soundproof material to take a countermeasure for noise and therefore, a higher cost can be prevented.

When as in the sheet conveying apparatus of the present invention, in its normal state or after sheet jam clearance, the rotary driving means are started in the order from the downstream side in the sheet conveying direction, even if it happens that the upstream end and downstream end of a sheet are interposed between the pair of rotary members on the upstream side and the pair of rotary members on the downstream side, the pair of rotary members on the downstream side can be prevented from pulling and tearing the sheet. Also, the rotary driving means on the upstream side can be prevented from being pulled by the rotary driving means on the downstream side through the intermediary of a sheet and stepping out.

If as in the sheet conveying apparatus of the present invention, the control means is adapted to accelerate and rotate the pair of rotary members to such a degree as not to impart damage to the sheet during the time after the conveyance of the sheet is started and until the sheet assumes a predetermined conveying speed, the conveyance of the sheet can be started without imparting damage to the sheet.

If as in the sheet conveying apparatus of the present invention, a plurality of sheet detecting means for detecting the sheet are disposed along the sheet conveying path and the control means is adapted to stop the rotary driving means when a jammed sheet is detected by the sheet detecting means, the rotary driving means can be stopped to thereby prevent the sheet conveying apparatus from being damaged when sheet jam occurs.

The image forming apparatus of the present invention is provided with the above-described sheet conveying apparatus which is small in starting sound and therefore, it becomes unnecessary to increase the strength of each part or use a damping material and a soundproof material to take a countermeasure for noise and thus, any increase in cost can be prevented. Also, the apparatus can be made compact.

What is claimed is:

1. A sheet conveying apparatus comprising:

a plurality of pairs of rotary members, disposed along a sheet conveying path for guiding a sheet, for conveying said sheet;

a plurality of rotary driving means for rotating said plurality of pairs of rotary members; and control means for starting said plurality of rotary driving means such that starting times of each of said plurality of rotary driving means are staggered when a power source switch of said sheet conveying apparatus is closed.

2. A sheet conveying apparatus according to claim 1, wherein said control means starts said plurality of rotary driving means in an order from a rotary driving means corresponding to a pair of rotary members on an upstream side in a sheet conveying direction.

3. A sheet conveying apparatus according to claim 2, wherein from the rotary driving means corresponding to the pair of rotary members on said upside, said rotary driving means are divided into a plurality of groups, and said control means starts said rotary driving means in an order from a group on said upstream side.

4. A sheet conveying apparatus according to claim 1, 2 or 3, wherein said control means accelerates and rotates said plurality of pairs of rotary members an amount sufficient to not impart damage to the sheet during the time after a conveyance of said sheet is started and until said sheet assumes a predetermined conveyance speed.

5. A sheet conveying apparatus according to claim 1 or 2, further comprising a plurality of sheet detecting means for detecting the sheet, said plurality of sheet detecting means disposed along said sheet conveying path, and said control means stops said plurality of rotary driving means when a jammed sheet is detected by said plurality of sheet detecting means.

6. A sheet conveying apparatus according to claim 1, 2 or 3, wherein said plurality of pairs of rotary members are pairs of rollers, and said plurality of rotary driving means are motors.

7. A sheet conveying apparatus according to claim 1, 2 or 3, wherein said plurality of rotary driving means include a clutch for transmitting a rotational force of a motor to said pairs of rotary members.

8. An image forming apparatus comprising:

a sheet conveying apparatus as recited in any one of claims 1 to 3; and image forming means disposed in a course of a sheet conveying path of said sheet conveying apparatus for forming an image on a sheet conveyed along said sheet conveying path.

9. A sheet conveying apparatus comprising:

a plurality of conveying means provided with at least one rotary member for conveying a sheet along a sheet conveying path, and each driven by independent driving means;

a plurality of sheet detecting means for detecting a presence of the sheet at predetermined positions of said sheet conveying path; and control means for controlling each of said driving means when a power source switch of said sheet conveying apparatus is closed so as to start said driving means such that starting times of each of said driving means are staggered, and to stop said driving means in accordance with a detection of the sheet by said plurality of sheet detecting means after a start of said driving means.

10. A sheet conveying apparatus according to claim 9, wherein each of said sheet conveying means has at least one rotary member for contacting with the sheet and being rotated to thereby convey the sheet.

11. A sheet conveying apparatus according to claim 9 or 10, wherein said control means starts each said driving means in an order from the driving means for driving conveying means on an the upstream side of the sheet conveying path.

12. An image forming apparatus comprising:

a sheet conveying apparatus as recited in claim 9; and image forming means disposed in a course of a sheet conveying path of said sheet conveying apparatus for forming an image on a sheet conveyed along said sheet conveying path.

13. A sheet conveying apparatus comprising:

a plurality of conveying means provided with at least one rotary member for contacting with a sheet and being rotated to thereby convey the sheet along a sheet conveying path, and each driven by independent driving means;

a door openable and closable to clear a sheet jammed in said sheet conveying path;

detecting means for detecting that said door has been closed;

a plurality of sheet detecting means for detecting a presence of the sheet at predetermined positions of said sheet conveying path; and control means for controlling each of said driving means when said detecting means detects that said door is closed so as to start said driving means such that starting times of each of said driving means are staggered, and to stop said driving means in accordance with a detection of the sheet by said plurality of sheet detecting means after a start of said driving means.

14. A sheet conveying apparatus according to claim 13, wherein said control means starts each said driving means in an order from driving means for driving conveying means on an upstream side of the sheet conveying path.

15. An image forming apparatus comprising:

a sheet conveying apparatus as recited in claim 13 or 14; and image forming means disposed in a course of a sheet conveying path of said sheet conveying apparatus for forming an image on a sheet conveyed along said sheet conveying path.

* * * * *

UNITED STATES PATENT AND TRADEMARK OFFICE

CERTIFICATE OF CORRECTION

PATENT NO. : 6,289,183 B1
DATED : September 11, 2001
INVENTOR(S) : Hiroaki Miyake It is certified that error appears in the above-identified patent and that said Letters Patent is hereby corrected as shown below:

Column 2,
Line 25, "pulls and tears" should read -- pull and tear --.
Line 31, "member" should read -- members --.

Column 6,
Line 31, "Ml" should read -- M1 --.
Line 39, "stepout" should read -- step-out --.

Column 8,
Line 31, "upside," should read -- upstream side, --.

Column 9,
Line 18, "an the" should read -- an --.

Signed and Sealed this

Second Day of April, 2002

*Attest:*

*Attesting Officer*

JAMES E. ROGAN
*Director of the United States Patent and Trademark Office*